US005386604A

United States Patent [19]

Ricketts

[11] Patent Number: 5,386,604

[45] Date of Patent: Feb. 7, 1995

[54] PATIENT RESCUE BAG

[76] Inventor: Robert A. Ricketts, Box 1077, Polson, Mont. 59860

[21] Appl. No.: 71,538

[22] Filed: Jun. 4, 1993

[51] Int. Cl.[6] ..... A61G 7/10

[52] U.S. Cl. ..... 5/625; 5/627; 5/628; 5/413; 5/484

[58] Field of Search ..... 5/625–628, 5/89.1, 413, 484–486, 494, 502; 2/69.5

[56] References Cited

U.S. PATENT DOCUMENTS

| | | | |
|---|---|---|---|
| 3,178,734 | 4/1965 | Carrez | 5/413 |
| 3,510,889 | 5/1970 | Peterson | 2/69.5 |
| 3,962,738 | 6/1976 | Menditto | 5/494 |
| 4,124,908 | 11/1978 | Burns et al. | 5/628 |
| 4,513,461 | 4/1985 | Tardivel | 5/413 |
| 4,790,040 | 12/1988 | Grilliot et al. | 5/625 X |
| 5,005,235 | 4/1991 | Huang | 5/413 |
| 5,086,530 | 2/1992 | Blake | 5/502 |
| 5,189,746 | 3/1993 | Horie | 5/628 X |
| 5,193,235 | 3/1993 | Kircher | 5/413 |

*Primary Examiner*—Michael F. Trettel
*Attorney, Agent, or Firm*—Frost & Jacobs

[57] ABSTRACT

A patient rescue bag is provided with an upper portion and a lower portion for use in carrying an injured person from a remote location that is not accessible by normal emergency vehicles. Once the injured person is placed between the upper and lower portions of the patient rescue bag, that person may be easily carried by rescue workers while being kept comfortable and warm. In addition, each of the outer edges of the upper and lower portions can be detached from one another so that the patient can be reached from any location around the periphery of the patient rescue bag. By use of multiple strips of hook and loop fastener material, such as VELCRO®, the width of the patient rescue bag can be adjusted to the size of the injured person being carried. The outer materials of the patient rescue bag are weatherproof and reusable, and the inner materials that touch the patient are clean, disposable sheets similar to those used in hospitals. An insulative core made of down is provided within the weatherproof exterior of the patient rescue bag, thereby enabling the patient to be kept warm even in cold climates. The insulative core is available in other materials, such as cotton, for use in warmer climates.

16 Claims, 9 Drawing Sheets

10
132
128
48
56
176
26
28
40
38
36
46
30
34
130
126
174
104
100
20
102
106
98
90
86
82
54
74
72
70
96
94
92
88
84
80
52
50
64
66
68
62
60
58
22
110
112
44
28
38
26
120
47
42
124
32
36
126
46
30
2
2

PATIENT RESCUE BAG

TECHNICAL FIELD

The present invention relates generally to safety and rescue equipment and is particularly directed to a means for keeping a person warm and comfortable after the person has been injured and must be removed from a location that is remote from normal transportation routes. The invention is specifically disclosed as a rescue bag in which a person can be placed for being carried from a remote location to a site which can be easily reached by normal emergency rescue vehicles.

BACKGROUND OF THE INVENTION

When a person is injured in a remote location, rescue workers often are required to hand carry the person on a stretcher to a location where an ambulance or helicopter can be reached. This is particularly true in remote locations consisting of rough terrain such as mountains, and in such circumstances the injured person would be exposed to the elements until the emergency rescue vehicle could be reached. In many instances, the rescue workers take their coats off and place them on the injured person to keep that person warm while being carried on the stretcher.

A more desirable result in such situations would be to have some type of lightweight bedding to keep the patient warm while the patient is being carried on the stretcher, as retention of body heat can be critical. A mere sleeping bag could be used in such a situation, however, the patient would not be immediately accessible from all directions due to the use of zippers along one of two edges of the sleeping bag. Standard blankets are also not the most desirable apparatus in such a situation, because the blankets can be heavy and bulky to carry, and they may not easily stay in place while the stretcher is being carried, and the blankets may become soaked in situations where there is precipitation.

SUMMARY OF THE INVENTION

Accordingly, it is a primary object of the present invention to provide a patient rescue bag which can act as light-weight bedding to keep a patient warm, in which the bedding is weatherproof and reusable.

It is another object of the present invention to provide a patient rescue bag that has quick and easy access to the patient from all directions by providing a non-attaching opening at one edge of the bag, and by providing means for releasably securing an upper and lower portion of the bag to one another along two or three edges of the bag such that the upper and lower portions may be easily separated at any point along each of these edges, and so that a supine patient initially may be placed on top of the lower portion of the bag, then the upper portion of the bag can be moved over the top of the patient with easy attachment points along the at least three edges of the bag.

It is a further object of the present invention to provide a patient rescue bag which includes disposable hospital liquid-proof or blood-proof sheeting that will cover the patient, both above and below the patient, and that can be quickly replaced so that the patient rescue bag can be reused.

Additional objects, advantages and other novel features of the invention will be set forth in part in the description that follows and in part will become apparent to those skilled in the art upon examination of the following or may be learned with the practice of the invention.

To achieve the foregoing and other objects, and in accordance with one aspect of the present invention, an improved patient rescue bag is provided made of weatherproof, light-weight bedding that will keep a patient warm while being carried on a stretcher. The patient rescue bag includes two major portions, an upper portion and a lower portion, which are easily detachable from one another to allow quick and easy access to a supine patient once the patient is placed inside the bag. The edges of the upper and lower portions are lined with quick-operating attachable/detachable fastener devices, such as zippers or hook and loop fasteners, so that two or, preferably, three edges of the upper portion can be easily detached from the lower portion. The attachable/detachable fastener devices act to releasably secure the upper and lower portions together such that access to the patient is easily accomplished from any point along the edges of the patient rescue bag without disturbing other parts of the edges from which access is not presently desired. A non-attaching opening is provided along at least one of the edges for easy access to the patient's head. The upper and lower portions are insulated with down or some other flexible, insulative material so that the patient will be kept warm during transport. The inner surfaces of both upper and lower portions include detachable, disposable hospital liquid-proof or blood-proof sheeting, so that the patient will be in contact with a clean surface. This disposable sheeting is quickly attachable/detachable from both the upper and lower portions of the rescue bag, so that they can be quickly replaced for immediate reuse of the patient rescue bag. The outer layers of the upper and lower portions comprise a waterproof covering material, such as ULTREX TM.

The patient rescue bag can be divided into two halves by separating the upper and lower portions from one another and using each half as a "wrap" to keep one or more supine persons warm during an emergency. Each "wrap" half is large enough to cover two or three supine persons should an emergency rescue crew come upon a situation where several persons simultaneously need to be protected.

The patient rescue bag can additionally be made with strong handles at each of the corners of the upper portions of the rescue bag, so the rescue bag can be used as a stand-alone stretcher. These handles are strong enough to support the weight of the person being carried within the rescue bag, and are easily handled by a crew of rescue workers. The handles are made of a strong, flexible material such as nylon strapping.

Still other objects of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE INVENTION

Reference will now be made in detail to the present preferred embodiment of the invention, an example of which is illustrated in the accompanying drawings, wherein like numerals indicate the same elements throughout the views.

Figure 1:
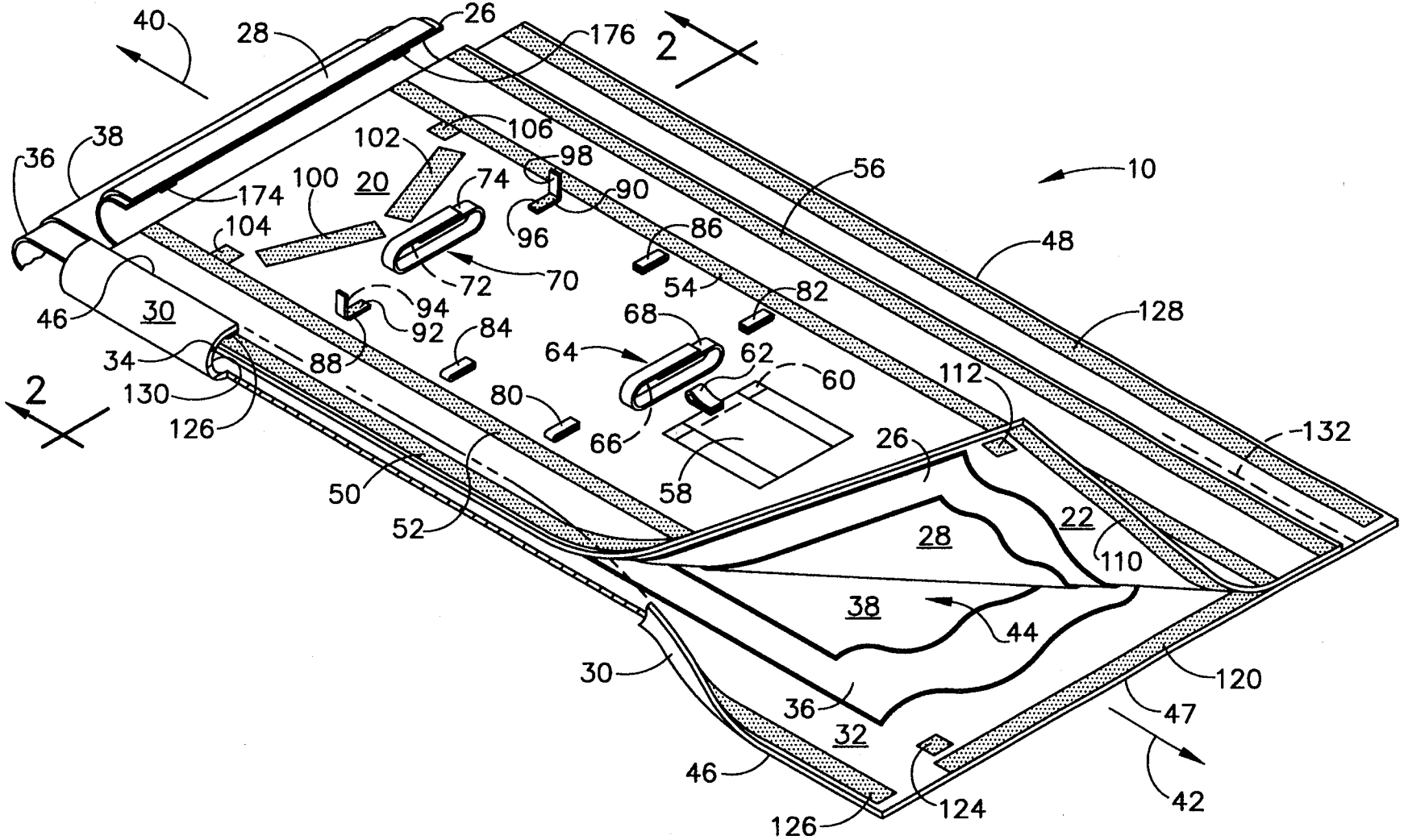
FIG. 1 is a perspective fragmentary view of a patient rescue bag constructed in accordance with the principles of the present invention.

Referring now to the drawings, FIG. 1 shows a patient rescue bag generally indicated by the index numeral 10. Patient rescue bag 10 largely comprises an upper portion 12 and lower portion 14, of which upper portion 12 includes a top outer layer 20, which has various appendages that will be discussed hereinbelow, and which is preferably sewn or glued to a top inner layer 22. Top outer layer 20 and top inner layer 22 have generally rectangular perimeters and preferably are made to substantially the same length and width dimensions so that their longitudinal and transverse edges can be permanently attached together, respectively, at their perimeters when one layer is placed upon the other. A top insulative core 24 (see FIG. 2) is positioned between top outer layer 20 and top inner layer 22. The edges of these two layers are preferably sewn together along three of their four edges, however, a permanent glue could be used as an alternative method of their attachment to one another.

Top outer layer 20 is preferably removably attached to top inner layer 22 along their fourth edge so that access is available to the inner space between these two layers. A transverse strip (not shown) of a hook and loop fastener material, such as VELCRO®, is preferably attached to the inner surface of top inner layer 22 (on the opposite side of inner layer 22 from the VELCRO® strip 110 as depicted in FIG. 1), and is made of either male or female VELCRO®. A mating strip (not shown) of VELCRO® is also attached to the inner surface of top outer layer 20 so that, when these two VELCRO® strips are engaged together, the fourth edge is mechanically closed.

Figure 2:
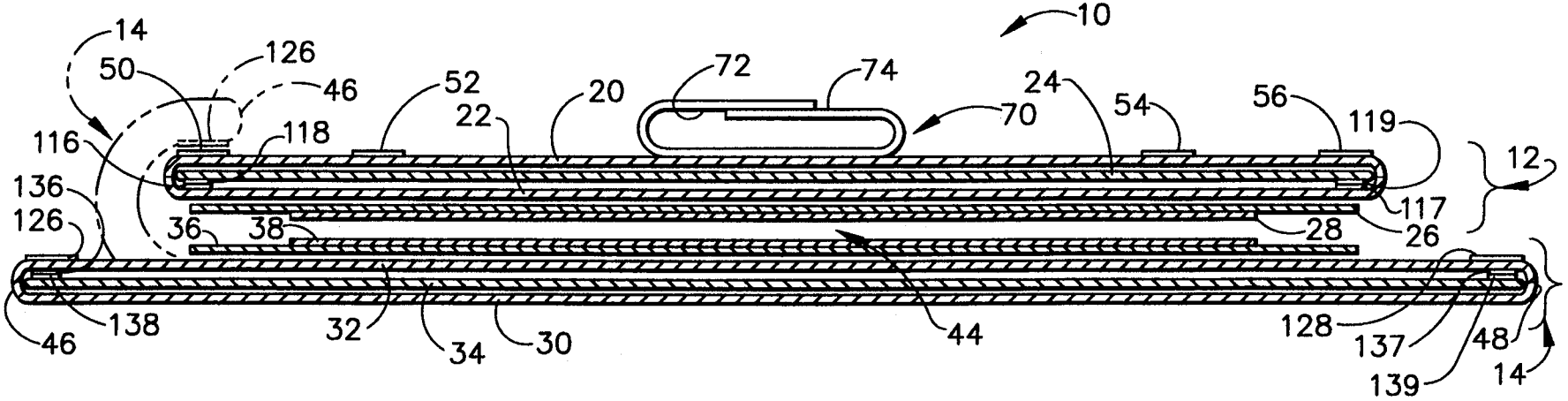
FIG. 2 is a cross-sectional view taken along the lines 2—2 of FIG. 1, in which the vertical scale is expanded as compared to the horizontal scale.

Top outer layer 20 and top inner layer 22 are preferably constructed of a waterproof, flexible material. One appropriate material for such use is ULTREX TM manufactured by Burlington, located in Raleigh, N.C. A preferred material for top insulative core 24 is down, however, it will be understood that any type of flexible thermal insulative material could be used in this application. Other exemplary materials for top insulative core 24 are cotton or a synthetic fiber such as QUALIFIL TM (manufactured by DuPont). Top insulative core 24 can be removed from patient rescue bag 10 by disengaging the two VELCRO® strips which are located along the fourth edge of top inner layer 22 and top outer layer 20, then reaching into the inner space between these two layers and disconnecting top insulative core 24 from its attachment points. The attachment points preferably comprise VELCRO® patches which are attached to both top insulative core 24 and top inner layer 22. These attachment points are preferably located at the corners of top insulative core 24, such as depicted in FIG. 2 as male VELCRO® patches 116 and 117 and female VELCRO® patches 118 and 119. Similar sets of attachment points (not shown) are preferably located at the opposite corners of top insulative core 24.

Since top insulative core 24 is removable, a material can be chosen to work with various ambient temperatures that patient rescue bag 10 may be utilized in. For example, patient rescue bag 10 can be used in ambient temperatures ranging from −40° F. (−40° C.) to +100° F. (+38° C.) by simply choosing the correct material for top insulative core 24. For the coldest ambient temperatures, top insulative core 24 should comprise down. For somewhat warmer ambient temperatures, a synthetic fibrous material such as QUALIFIL TM can be used; for even warmer ambient temperatures, a cotton material can be used. For the warmest ambient temperatures, top insulative core 24 can simply be deleted from patient rescue bag 10, so that a patient is not kept too warm.

A top liquid-proof sheet 26 is removably attached to top inner layer 22. A thin layer of absorbent sheet material 28 is attached along one side of top liquid-proof sheet 26. In the illustrated embodiment of FIG. 1, top absorbent sheet 28 is releasably attached to the lower surface of top liquid-proof sheet 26. Top liquid-proof sheet 26 is preferably made of some type of plastic material such as LAYTEX TM, and top absorbent sheet 28 is preferably made of a paper or cloth material such as cotton fiber. The combination of top liquid-proof sheet 26 and top absorbent sheet 28 is also available in the prior art in a form where the plastic material (of sheet 26) is bonded in certain locations to top absorbent sheet 28, typically along the edges of top absorbent sheet 28.

Top outer layer 20, top inner layer 22, top insulative core 24, top liquid-proof sheet 26, and top absorbent sheet 28 as a sub-assembly form upper portion 12 (see FIG. 2) which is placed on top of a patient so that the patient can be kept warm. Lower portion 14 (see FIG. 2) is located beneath the patient, and the patient, therefore, is retained in a patient area, which is generally designated by the index numeral 44.

A bottom outer layer 30 and a bottom inner layer 32 also have generally rectangular perimeters and preferably are made to substantially the same length and width dimensions so that their longitudinal and transverse edges can be permanently attached together, respectively, at their perimeters and around a bottom insulative core 34. Bottom insulative core 34 is preferably made of down (for thermal insulation), cotton, or a synthetic fiber such as QUALIFIL TM, and bottom outer and inner layers 30 and 32, respectively, are preferably made of a waterproof, flexible material such as ULTREX TM.

Bottom insulative core 34 (see FIG. 2) is positioned between bottom outer layer 30 and bottom inner layer 32. The edges of these two layers are preferably sewn together along three of the four edges, however, a permanent glue could be used as an alternative method of their attachment to one another. Bottom outer layer 30 is preferably removably attached to bottom inner layer 32 along the fourth edge so that access is available to the inner space between these two layers. A transverse strip (not shown) of a hook and loop fastener material, such as VELCRO®, is preferably attached to the inner surface of bottom inner layer 32 (on the opposite side of inner layer 32 from the VELCRO® strip 120 as depicted in FIG. 1), and is made of either male or female VELCRO®. A mating strip (not shown) of VELCRO® is also attached to the inner surface of bottom outer layer 30 so that, when these two VELCRO® strips are engaged together, the fourth edge is mechanically closed.

Bottom insulative core 34 can be removed from patient rescue bag 10 by disengaging the two VELCRO® strips which are located along the fourth edge of bottom inner layer 32 and bottom outer layer 30, then reaching into the inner space between these two layers and disconnecting top insulative core 34 from its attachment points. The attachment points preferably comprise VELCRO® patches which are attached to both bottom insulative core 34 and bottom inner layer 32. These attachment points are preferably located at the corners of bottom insulative core 34, such as depicted in FIG. 2 as male VELCRO® patches 136 and 137 and female VELCRO® patches 138 and 139. Similar sets of attachment points (not shown) are preferably located at the opposite corners of bottom insulative core 34.

Since bottom insulative core 34 is removable, a material can be chosen to work with various ambient temperatures that patient rescue bag 10 may be utilized in. For example, patient rescue bag 10 can be used in ambient temperatures ranging from −40° F. (−40° C.) to +100° F. (+38° C.) by simply choosing the correct material for both the top insulative core 24 and bottom insulative core 34. The same materials can be used for bottom insulative core 34 as are used with top insulative core 24, and as before, for the coldest ambient temperatures, bottom insulative core 34 should comprise down. For somewhat warmer ambient temperatures, a synthetic fibrous material such as QUALIFIL TM can be used; for even warmer ambient temperatures, a cotton material can be used. For the warmest ambient temperatures, bottom insulative core 34 can simply be deleted from patient rescue bag 10, so that a patient is not kept too warm.

A bottom liquid-proof sheet 36 is provided to quickly attach to or detach from bottom inner layer 32. A bottom absorbent sheet 38 is also provided as a thin layer of cloth or paper material disposed adjacent to the upper surface of bottom liquid-proof sheet 36. Bottom liquid-proof sheet 36 is preferably made of a plastic material such as LAYTEX TM, and bottom absorbent sheet 38 is preferably made of a paper or cloth material such as cotton fiber. The combination of bottom liquid-proof sheet 36 and bottom absorbent sheet 38 is also available in the prior art in a form where the plastic material (of sheet 36) is bonded in certain locations to bottom absorbent sheet 38, typically along the edges of bottom absorbent sheet 38.

Bottom outer layer 30, bottom inner layer 32, bottom insulative core 34, bottom liquid-proof sheet 36, and bottom absorbent sheet 38 as a combination make up lower portion 14, which is somewhat wider than upper portion 12. As can be seen in FIGS. 1 and 2, lower portion 14 is flexible such that it can be folded or rolled near its longitudinal edges 46 and 48. With index numeral 40 representing the "head" direction of patient rescue bag 10 and index numeral 42 representing the "feet" direction of patient rescue bag 10 it can be seen that longitudinal edges 46 and 48 are parallel to the length of a patient's body as the patient occupies patient area 44. The attachment of upper portion 12 to lower portion 14 will be discussed in detail, hereinbelow.

Figure 3:
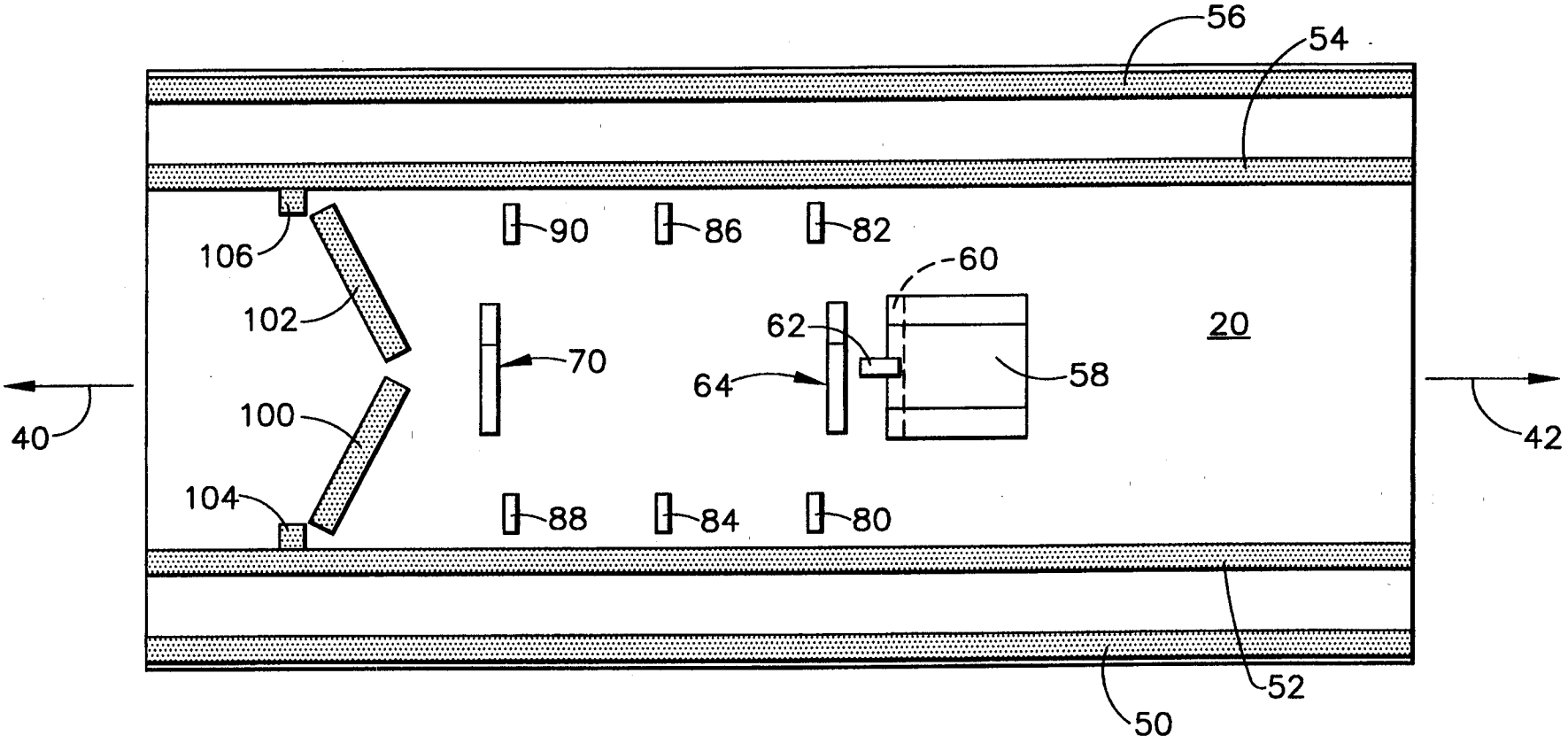
FIG. 3 is a top plan view of the outer layer of the upper portion of the patient rescue bag of FIG. 1.

The upper surface of top outer layer 20 is illustrated in detail in FIGS. 1 and 3, which show the direction toward the head area as arrow 40 and the direction toward the feet area as arrow 42. Top outer layer 20 preferably includes several long strips of a hook and loop fastener, such as VELCRO®, which are used to attach and easily detach certain external items to patient rescue bag 10, or to temporarily attach certain portions of patient rescue bag 10 to one another. For example, there preferably are four longitudinal VELCRO® strips 50, 52, 54 and 56 which run along the longitudinal edges of top outer layer 20, which strips are preferably made of female VELCRO® material. Other portions of male VELCRO® material which are attached to lower portion 14 can be temporarily attached to one or more of the these female VELCRO® strips, details of such will be discussed hereinbelow.

It will be understood that the use of the term VELCRO® herein refers generally to hook and loop fastener devices that are easily attachable and detachable, and which can either comprise VELCRO® brand hook and loop fasteners, or a different brand. The term "male" VELCRO® herein represents the "hooks" portion of the fastener, and the term "female" VELCRO® represents the "loops" portion of the fastener.

A pleated pouch 58 is preferably included on the surface of top layer 20, having a VELCRO® fastener 60, a portion of which comprises male and female VELCRO® on opposing surfaces of the pouch opening. A nylon strap or handle 62 is permanently attached to the upper portion of pouch 58, i.e., at the opening where the VELCRO® fastener 60 is located. Strap/handle 62 can be easily grasped by the fingers of a hand to easily open pouch 58.

Two relatively large carrying straps or handles 64 and 70 are also attached to the mid-portion of the upper surface of top outer layer 20. Carrying straps/handles 64 and 70 are preferably constructed to be large enough and strong enough to hold a heart monitor and/or I.V. pumps in place on the surface of top outer layer 20. Carrying strap/handle 64 is preferably made of a nylon web or strap material which has a male VELCRO® surface 66 and a mating female VELCRO® surface 68, such that the ends of this nylon strap can be detached from one another to open the handle, and to close together so as to form the carrying handle. In a similar manner, carrying strap/handle 70 includes a male VEL- CRO ® surface 72 along with a mating female VELCRO ® surface 74 to form the same type of open, then closed handle.

Several other straps or handles are preferably attached to the upper surface of top outer layer 20 for use to hold I.V. lines in place on the surface of top outer layer 20. These straps/handles are preferably made of nylon webbing, and are permanently attached to top outer layer 20 at the locations designated by index numerals 80, 82, 84, 86, 88, and 90. Each of the straps/handles are lined with male and female VELCRO ® along their inner surfaces, such as strap/handle 88, for example, having a male VELCRO ® surface 92 and a female VELCRO ® surface 94. In a similar manner, strap/-handle 90 preferably has a male VELCRO ® surface 96 and a corresponding female VELCRO ® surface 98 that would mate to male VELCRO ® surface 96.

Other VELCRO ® strips can be placed upon the upper surface of top outer layer 20 for various uses, such as female VELCRO ® strips 100 and 102. Such large areas of VELCRO ® strip are useful for closing the area around a patient's neck as the patient rests within patient area 44, or in temporarily attaching patient rescue bag 10 to various other devices, such as a wall of some type of safety equipment storage container. Some smaller VELCRO ® patches are also preferably attached to the upper surface of top outer layer 20. Two such patches, designated by index numerals 104 and 106, are located near the head area of top outer layer 20, and are used to temporarily hold one end of the top liquid-proof sheet 26 in place.

Figure 7A:
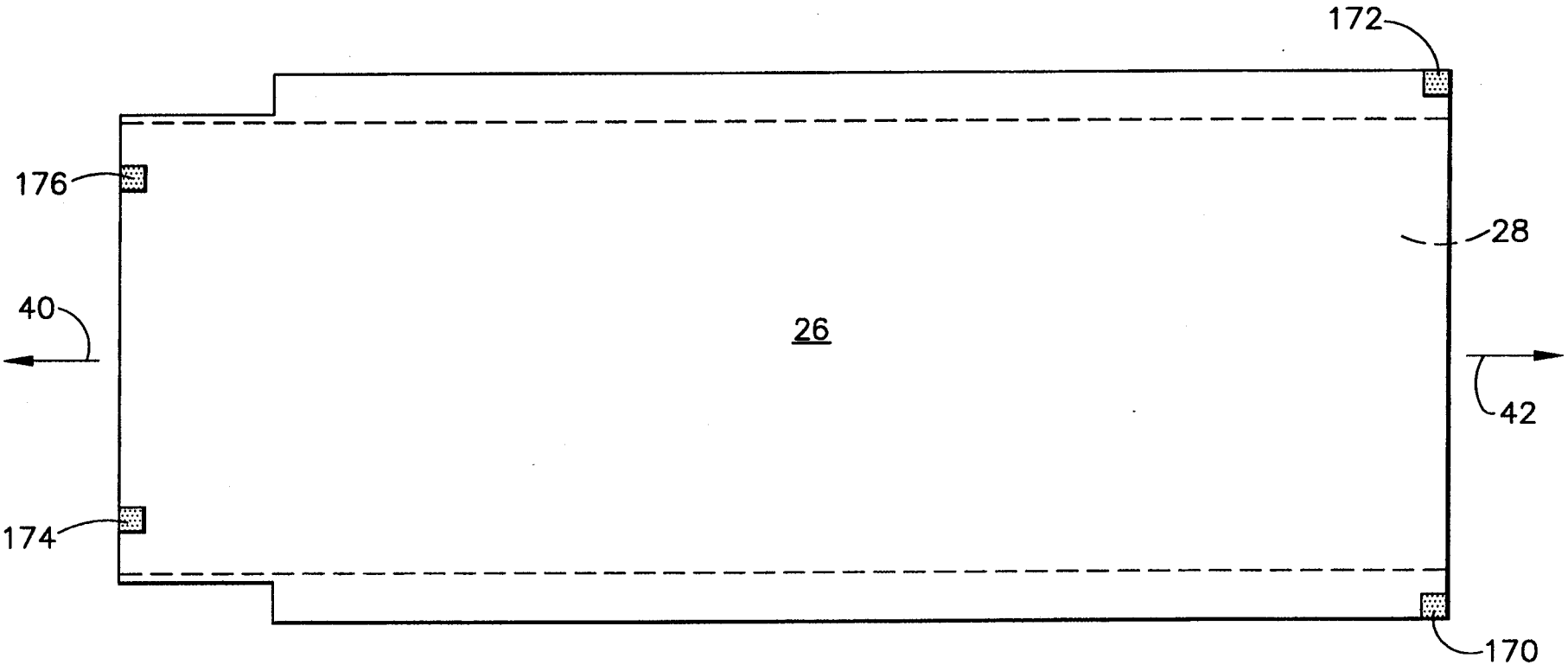
FIG. 7A is a top plan view of the liquid-proof sheet of the upper portion of the patient rescue bag of FIG. 1.

As can be seen in FIG. 7A, top liquid-proof sheet 26 preferably includes four VELCRO ® patches, 170, 172, 174, and 176. These VELCRO ® patches are made of male VELCRO ® material, and are permanently attached to the upper side of top liquid-proof sheet 26 as viewed in FIGS. 1 and 2. Top liquid-proof sheet 26 is preferably longer, along its longitudinal axis, than the length of upper portion 12. As can be seen in FIG. 1, the extra length of top liquid-proof sheet 26 allows it to extend past the edge of upper portion 12 in the head direction 40, and then fold around and above the upper surface of top outer layer 20. In this position, male VELCRO ® patch 174 can be mated to female VELCRO ® patch 104, and male VELCRO ® patch 176 can be mated to female VELCRO ® patch 106. This mating of these two VELCRO ® patch pairs is sufficient to temporarily hold top liquid-proof sheet 26 in place while a patient is being carried in patient rescue bag 10. The top absorbent sheet 28, which is attached to the lower surface of top liquid-proof sheet 26, will then be directly touching the patient while the patient is in a supine position within patient area 44. The opposite end of top liquid-proof sheet 26 in the direction of arrow 42 (i.e., the feet end) also includes VELCRO ® patches which attach to top inner layer 22. This will be described in greater detail hereinbelow.

Figure 4:
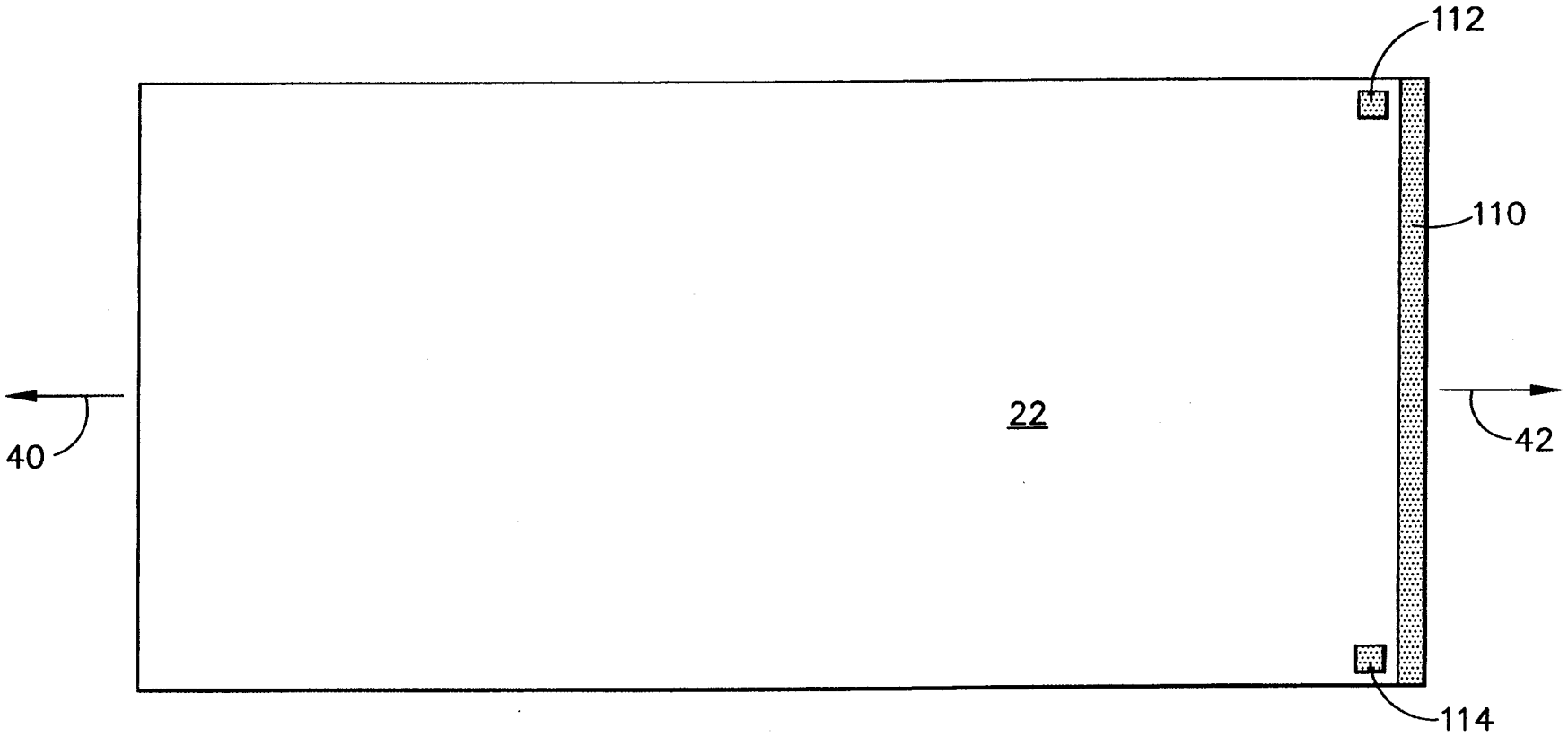
FIG. 4 is a bottom plan view of the inner layer of the upper portion of the patient rescue bag of FIG. 1.

The lower surface of top inner layer 22 is illustrated in FIG. 4 as preferably having two VELCRO ® patches 112 and 114, and one relatively long VELCRO ® strip 110. The long VELCRO ® strip 110 is preferably made of male VELCRO ® material and runs in the transverse direction along the edge of top inner layer 22 that is nearest the feet direction 42. VELCRO ® patches 112 and 114 are preferably both made of female VELCRO ® material, and are located in comers near the feet direction 42 of top inner layer 22.

As described hereinabove, top liquid-proof sheet 26 has two VELCRO ® patches 170 and 172 which attach to the lower surface of top inner layer 22. Male VELCRO ® patch 170 mates to female VELCRO ® patch 112, and male VELCRO ® patch 172 mates to female VELCRO ® patch 114. Top liquid-proof sheet 26 is thus easily attached to the lower surface of top inner layer 22 near the transverse edge in the feet direction 42 of patient rescue bag 10. The size of VELCRO ® patches 170, 172, 174, and 176 are large enough to hold top liquid-proof sheet 26 in place while patient rescue bag 10 is in use, and small enough to permit top liquid-proof sheet 26 to be easily detached from the remaining portions of upper portion 12. In this manner, top liquid-proof sheet 26, along with its top absorbent sheet 28, is detachably affixed to upper portion 12, and is easily detached for disposal. A new top liquid-proof sheet 26 and top absorbent sheet 28 combination can then be attached to upper portion 12, thereby making patient rescue bag 10 readily available for repeated use.

Figure 5:
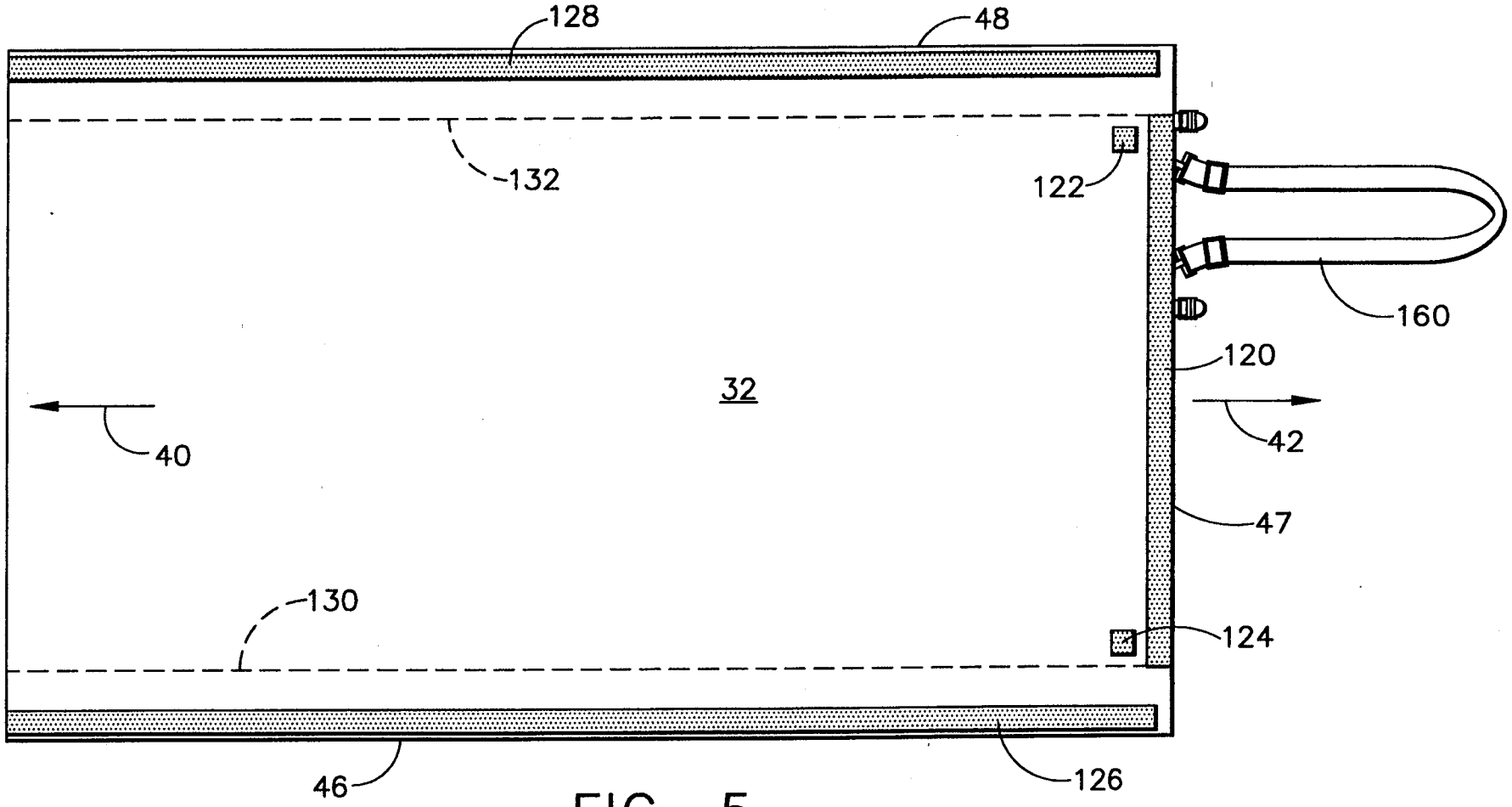
FIG. 5 is a top plan view of the inner layer of the lower portion of the patient rescue bag of FIG. 1.

The upper surface of bottom inner layer 32 is depicted in FIG. 5 and preferably contains three long VELCRO ® strips, as well as several smaller VELCRO ® patches of these strips, a female VELCRO ® strip 120 is permanently attached near the transverse edge 47 (in the feet direction 42) of bottom inner layer 32, and runs in the transverse direction along edge 47. Female VELCRO ® strip 120 preferably mates to male VELCRO ® strip 110, which is permanently attached in a similar fashion to top inner layer 22. Once a patient has been placed upon the surface of bottom inner layer 32, upper portion 12 can be placed on top of the patient and VELCRO ® strip 110 can be attached to VELCRO ® strip 120 to close the area nearest the patient's feet. VELCRO ® patches 122 and 124 are preferably made of female VELCRO ® material, and are designed to hold bottom liquid-proof sheet 36 in place, which will be discussed in detail hereinbelow.

VELCRO ® strips 126 and 128 are preferably made of male VELCRO ® and are located along the longitudinal edges 46 and 48 of bottom inner layer 32. As related hereinabove, lower portion 14 is wider than upper portion 12, and thus bottom inner layer 32 is wider than top inner layer 22 and top outer layer 20. Two longitudinal fold lines 130 and 132 are used to fold over the outer longitudinal edges 46 and 48 of bottom inner layer 32. With bottom inner layer 32 folded over along fold line 130, for example, as shown in FIGS. 1 and 2, male VELCRO ® strip 126 can then attach to either female VELCRO ® strip 50 or female VELCRO ® strip 52, as desired. In a similar manner, male VELCRO ® strip 128 can be folded over, along fold line 132, and attached to either female VELCRO ® strip 54 or female VELCRO ® strip 56. If a large adult patient is occupying patient area 44, then male VELCRO ® strip 126 would be mated to female VELCRO ® strip 50, and male VELCRO ® strip 128 would be mated to female VELCRO ® strip 56. As the size of the patient becomes smaller, the male VELCRO ® strips 126 and 128 can be attached to either or both of the inner female VELCRO ® strips 52 and 54.

As can be viewed in FIG. 1, the use of VELCRO ® strips 126, 128 and 120 (and their mating VELCRO ® strips 50, 52, 54, 56, and 110) along the longitudinal edges 46 and 48 as well as the transverse edge 47 provide a means for releasably securing upper portion 12 to lower portion 14. In addition, such releasably securing means allows access to a patient occupying patient area 44 from any direction (i.e., from any location) along edges 46, 47, and 48 without disturbing any other parts of the releasably securing means (i.e., along other portions of VELCRO® strips 126, 128 and 120). Other types of releasably securing means could alternatively be used in lieu of VELCRO®, however, a standard zipper may not provide such instantaneous access to a mid-portion of one of the edges 46, 47, or 48 without disturbing the remaining length of zipper along the corresponding edge.

Figure 6:
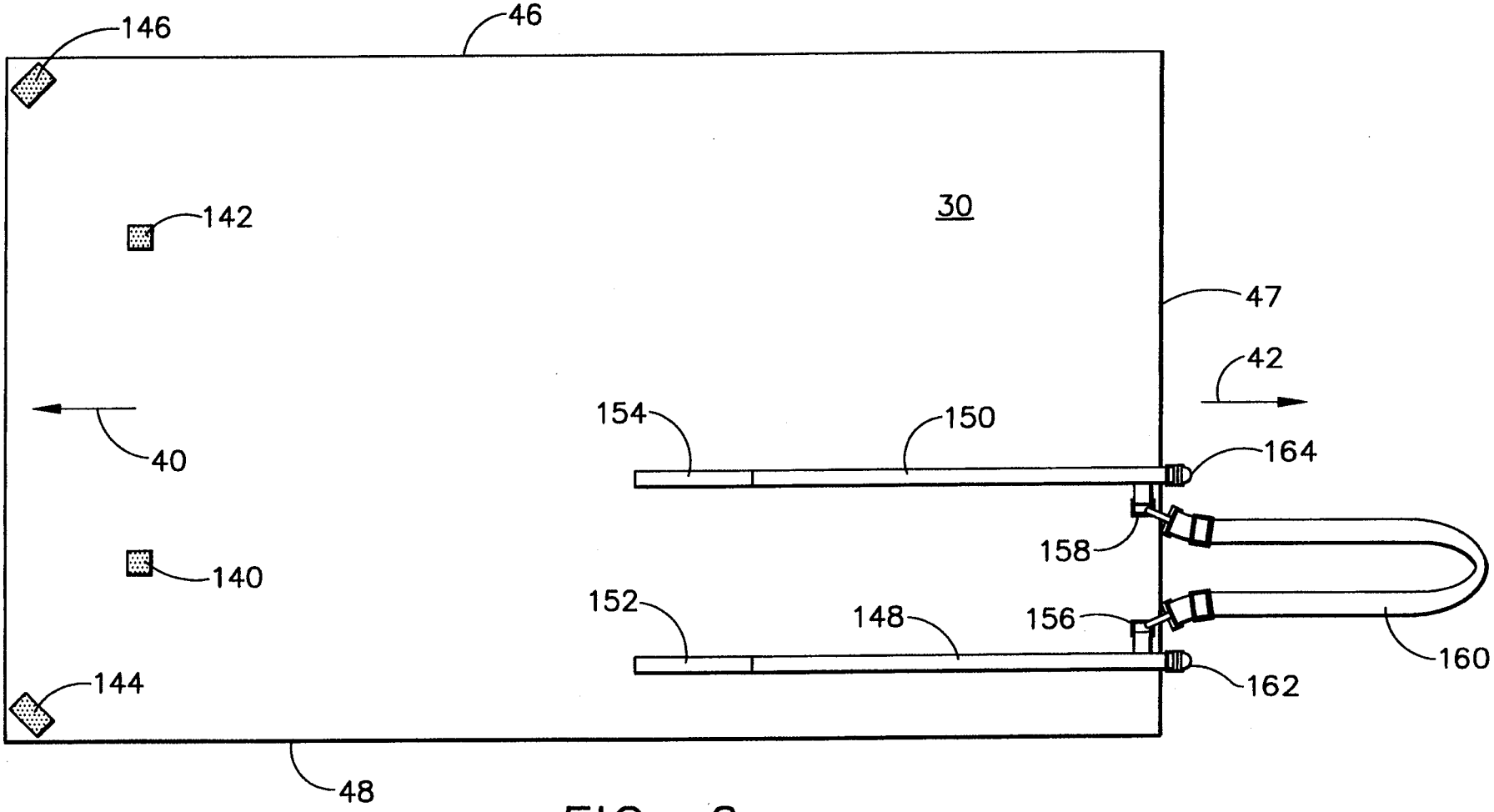
FIG. 6 is a bottom plan view of the outer layer of the lower portion of the patient rescue bag of FIG. 1.

The lower surface of bottom outer layer 30 is depicted in FIG. 6, and preferably includes a few VELCRO® patches as well as some nylon strapping material which can be used as a shoulder strap. Patches 140 and 142 are preferably made of female VELCRO® material, and will mate up to opposing VELCRO® material pieces 174*a* and 176*a* that will anchor bottom liquid-proof sheet 36 in place. The two VELCRO® patches in the corners near the head direction 40 of bottom outer layer 30, patches 144 and 146, are preferably made of male VELCRO® material.

A pair of straps 152 and 154, preferably made of nylon, are permanently sewn to bottom outer layer 30. These nylon straps continue, as designated by index numerals 148 and 150 until they terminate in quick connect/disconnect latches 156, 158, 162, and 164. As depicted in FIG. 6, these quick connect/disconnect latches are located near transverse edge 47. A shoulder strap 160, also preferably made of nylon strapping material, is attached to nylon straps 150 and 148 via quick connect/disconnect latches 156 and 158. Shoulder strap 160 can be used by a rescue worker to carry patient rescue bag 10 before it is deployed for use with a patient.

Figure 7B:
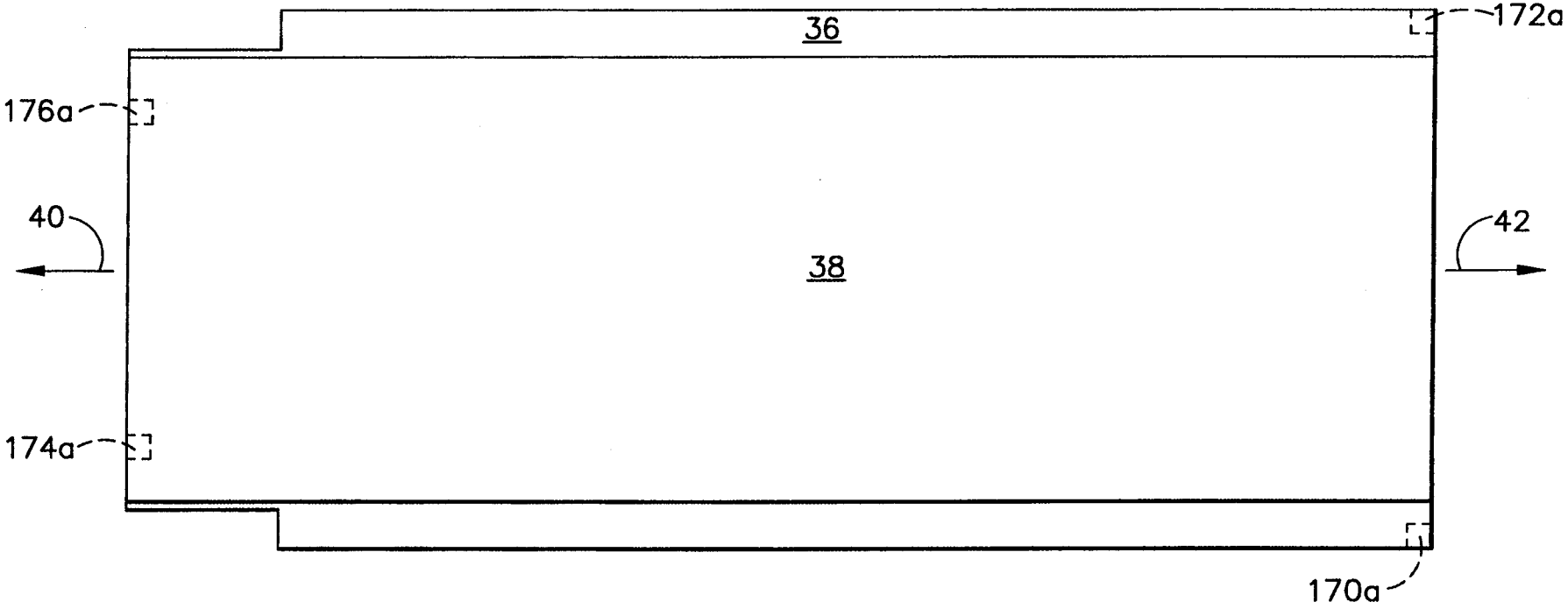
FIG. 7B is a top plan view of the liquid-proof sheet of the lower portion of the patient rescue bag of FIG. 1.

A top view of bottom liquid-proof sheet 36 is depicted in FIG. 7B as having four VELCRO® patches 170*a*, 172*a*, 174*a*, and 176*a*, on its lower surfaces. In addition, bottom absorbent sheet 38 is permanently attached to the upper surface of bottom liquid-proof sheet 36. Patch 170*a* is made of male VELCRO®, and will mate to female VELCRO® patch 124, which is located on the upper surface of bottom inner layer 32. In a similar manner, male VELCRO® patch 172*a* will mate to female VELCRO® patch 122, thereby anchoring the feet area portion of bottom liquid-proof sheet 36 to bottom inner layer 32.

Male VELCRO® patch 174*a* will mate to female VELCRO® patch 142, which is located on the lower surface of bottom outer layer 30. In a similar manner, male VELCRO® patch 176*a* will mate to female VELCRO® patch 140, thereby anchoring the head area portion of bottom liquid-proof sheet 36 to bottom outer layer 30. By use of this construction, top liquid-proof sheet 36, along with its top absorbent sheet 38, is detachably affixed to lower portion 14, such that bottom liquid-proof sheet 36 and its associated bottom absorbent sheet 38 are easily attached to and detached from bottom inner and outer layers 32 and 30, respectively. After such bottom liquid-proof sheets 36 and 38 have been used, they can be disposed of and a new bottom liquid-proof sheet 36 and 38 combination can be easily attached by use of these four VELCRO® attachment areas.

It will be understood that other attachment materials than hook and loop fastener devices such as VELCRO® can be used to make the quick connect/disconnect fastener devices (the handles and latches) that are used with patient rescue bag 10 without departing from the principles of the present invention. In addition, other types of fastener devices can be used in certain areas of patient rescue bag 10. For example, a zipper could be used to attach the feet area portions of top inner layer 22 to bottom inner layer 32 instead of VELCRO® strips 110 and 120, respectively. Furthermore, other types of hook and loop fastener devices may be usable rather than VELCRO®.

Some type of pillow is preferably supplied with patient rescue bag 10 for use in comforting the patient once he or she is placed in patient area 44. A pillow 180 made of down material is illustrated in FIG. 8A, and would have a preferred length and width of 20"×14". The pillow covering 182 is preferably all cotton, and the pillow contents 184 are preferably made of down, cotton, or other fiber. A pillow case 186, illustrated in FIG. 8B, would be used to surround pillow 180. Pillow case 186 is preferably made of a waterproof material, and preferably has VELCRO® fastener strips 188 at the opening of pillow case 186. It will be understood that a zipper or other releasable fastener could be used instead of VELCRO® fastener strips 188. VELCRO® fastener strips 188 preferably comprise a male strip on one surface of pillow case 186 which mates to a female strip on the opposite surface.

Figure 8C:
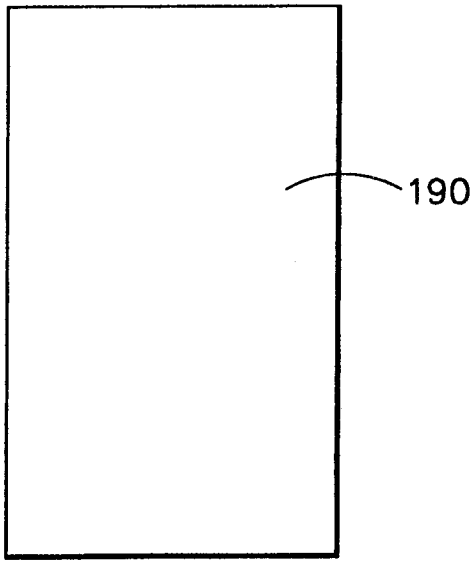
FIG. 8C is a plan view of the disposable case used for the pillow and pillow case of the patient rescue bag of FIG. 1.
Figure 8B:
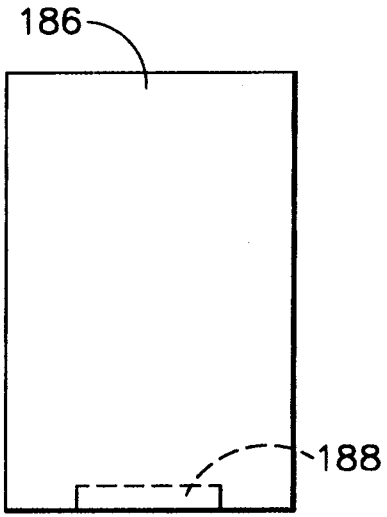
FIG. 8B is a plan view of the pillow case used with the patient rescue bag of FIG. 1.
Figure 8A:
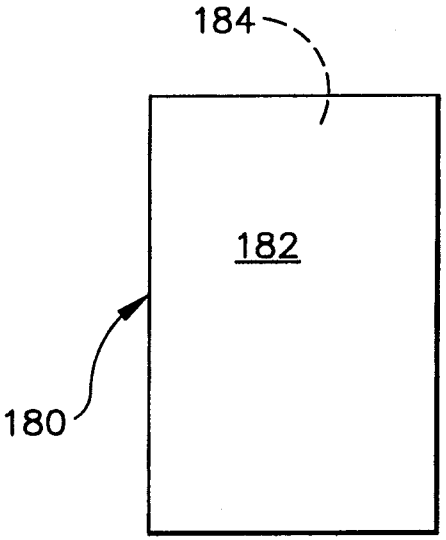
FIG. 8A is a plan view of the pillow used with the patient rescue bag of FIG. 1.

A disposable outer case 190 is depicted in FIG. 8C, and would preferably have an inner plastic surface which is waterproof, and an outer cloth or paper surface which would be comfortable to a patient's face and head. The inner plastic surface is preferably made of LAYTEX TM, and the outer cloth or paper surface is preferably made of cotton fiber. After use with a patient, outer case 190 can be disposed of and a new replacement outer case 190 can be slipped over pillow case 186 for future use.

The entire pillow 180, including its pillow case 186 and disposable outer case 190, can be retained within patient rescue bag 10 as patient rescue bag 10 is stored. Since pillow 180 is flexible, it can be located within patient area 44 (between upper portion 12 and lower portion 14) as patient rescue bag 10 is rolled up like a sleeping bag. Once patient rescue bag 10 has been rolled up and stored, it can be easily picked up by one person and carried in its entirety to any location where it may be needed.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A rescue bag, comprising an upper layer and a lower layer wherein a supine person can be placed therebetween, each of said upper and lower layers having a perimeter, edges at their perimeter wherein said edges have a first portion and a second portion, means for releasably securing said first portion of the edges to one another at all locations of said first portion, said second portion of the edges being non-attaching to one another; and two sheets, one of said sheets being releasably secured to the top surface of said lower layer, the other of said sheets being releasably secured to the bottom surface of said upper layer, said two sheets each comprising a layer of waterproof material and a layer of liquid-absorbing material.

2. The rescue bag as recited in claim 1, wherein said means for releasably securing said first portion of said edges to one another comprises latch and hook fasteners.

3. The rescue bag as recited in claim 1, wherein the perimeter of each of said upper and lower layers forms a substantially rectangular shape having four edges, and wherein said means for releasably securing said first portion of said edges are located along three of the edges of said rectangularly shaped perimeter.

4. The rescue bag as recited in claim 3, wherein said means for releasably securing said first portion of said edges is continuous along each of the corresponding edges.

5. The rescue bag as recited in claim 1, wherein the surfaces of said upper and lower layers comprise waterproof material.

6. The rescue bag as recited in claim 1, wherein said upper and lower layers each further comprise an interior layer of thermal insulative material.

7. A rescue bag, comprising:

(a) an upper portion having a generally rectangular shape with two longitudinal edges and two transverse edges and having a head area near one of said transverse edges and a foot area near the other of said transverse edges, said upper portion comprising:

(i) an outer surface, wherein said outer surface includes a first portion of a first quick connect-/disconnect fastener device that extends proximally to and along said two longitudinal edges;

(ii) an inner surface, wherein said inner surface includes a first portion of a second quick connect/disconnect fastener device that extends proximally to and along said transverse edge near said foot area;

(iii) an interior portion between said outer surface and said interior surface, wherein said interior portion comprises thermal insulative material;

(b) a lower portion having a generally rectangular shape with two longitudinal edges and two transverse edges and having a head area near one of said transverse edges and a foot area near the other of said transverse edges, said lower portion comprising:

(i) an outer surface;

(ii) an inner surface, wherein said inner surface includes a second portion of said first quick connect/disconnect fastener device that extends proximally to and along said two longitudinal edges, and a second portion of said second quick connect/disconnect fastener device that extends proximally to and along said transverse edge near said foot area, said second portion of the first quick connect/disconnect fastener device including means for coming into contact with and easily attaching to or detaching from said first portion of the first quick connect/disconnect fastener device, said second portion of the second quick connect/disconnect fastener device including means for coming into contact with and easily attaching to or detaching from said first portion of the second quick connect-/disconnect fastener device; and (iii) an interior portion between said outer surface and said interior surface, wherein said interior portion comprises thermal insulative material.

8. The rescue bag as recited in claim 7, further comprising:

(a) a first portion of a third quick connect/disconnect fastener device affixed to the inner surface of said upper portion proximal to said transverse edge near said foot area;

(b) a first portion of a fourth quick connect/disconnect fastener device affixed to the outer surface of said upper portion proximal to said transverse edge near said head area;

(c) a first sheet having a substantially rectangular shape with two longitudinal edges and two transverse edges, having a head area near one of said transverse edges and a foot area near the other of said transverse edges, said first sheet having a second portion of said third quick connect/disconnect fastener device affixed proximal to the transverse edge near said foot area, wherein said second portion of the third quick connect/disconnect fastener device includes means for coming into contact with and easily attaching to or detaching from said first portion of the third quick connect/disconnect fastener device, and said first sheet having a second portion of said fourth quick connect/disconnect fastener device affixed proximal to the transverse edge near said head area, wherein said second portion of the fourth quick connect/disconnect fastener device includes means for coming into contact with and easily attaching to or detaching from said first portion of the fourth quick connect-/disconnect fastener device;

(d) a first portion of a fifth quick connect/disconnect fastener device affixed to the inner surface of said lower portion proximal to said transverse edge near said foot area;

(e) a first portion of a sixth quick connect/disconnect fastener device affixed to the outer surface of said lower portion proximal to said transverse edge near said head area; and (f) a second sheet having a substantially rectangular shape with two longitudinal edges and two transverse edges, having a head area near one of said transverse edges and a foot area near the other of said transverse edges, said second sheet having a second portion of said fifth quick connect/disconnect fastener device affixed proximal to the transverse edge near said foot area, wherein said second portion of the fifth quick connect/disconnect fastener device includes means for coming into contact with and easily attaching to or detaching from said first portion of the fifth quick connect-/disconnect fastener device, and said second sheet having a second portion of said sixth quick connect/disconnect fastener device affixed proximal to the transverse edge near said head area, wherein said second portion of the sixth quick connect/disconnect fastener device includes means for coming into contact with and easily attaching to or detaching from said first portion of the sixth quick connect/disconnect fastener device..

9. The rescue bag as recited in claim 7, wherein said first and second quick connect/disconnect fastener devices comprise latch and hook fastener devices.

10. The rescue bag as recited in claim 8, wherein said first, second, third, fourth, fifth, and sixth quick connect/disconnect fastener devices comprise latch and hook fastener devices.

11. The rescue bag as recited in claim 7, wherein said inner and outer surfaces of the upper portion and said inner and outer surfaces of the lower portion comprise waterproof materials, and said thermal insulative material comprises down.

12. The rescue bag as recited in claim 8, wherein the surfaces of said first sheet and the surfaces of said second sheet each comprise waterproof materials.

13. The rescue bag as recited in claim 8, further comprising a third sheet affixed to said first sheet along its surface which faces said lower portion, and a fourth sheet affixed to said second sheet along its surface which faces said upper portion.

14. The rescue bag as recited in claim 13, wherein said third sheet and said fourth sheet each comprise liquid-absorbing materials.

15. The rescue bag as recited in claim 8, further comprising a pillow having a waterproof casing and an interior portion.

16. A rescue bag, comprising:

(a) an upper portion having a generally rectangular shape with two longitudinal edges and two transverse edges, said upper portion comprising:
  (i) an outer surface;
  (ii) an inner surface;
  (iii) thermal insulation;

(b) a lower portion having a generally rectangular shape with two longitudinal edges and two transverse edges, said lower portion comprising:
  (i) an outer surface;
  (ii) an inner surface;
  (iii) thermal insulation;

(c) first means for releasably securing the longitudinal edges of said upper portion to the longitudinal edges of said lower portion;

(d) second means for releasably securing at least one of the transverse edges of said upper portion to at least one of the corresponding transverse edges of said lower portion; and (e) two sheets, one of said sheets being releasably secured to the inner surface of said lower portion, the other of said sheets being releasably secured to the inner surface of said upper portion, the outer and inner surfaces of said upper and lower portions each comprising waterproof material, the thermal insulation of each of said upper and lower portion comprising down, the first and second means for releasably securing said longitudinal edges and at least one of the transverse edges of said upper portion to said lower portion comprise latch and hook fastener devices, and said two sheets each comprising a layer of waterproof material and a layer of liquid-absorbing material.

* * * * *